US005231245A

United States Patent [19]

Shann

[11] Patent Number: 5,231,245

[45] Date of Patent: Jul. 27, 1993

[54] EXPLOSIVES

[75] Inventor: Peter C. Shann, Fulford, Great Britain

[73] Assignee: Explosive Developments Limited, England

[21] Appl. No.: 543,749

[22] PCT Filed: Jan. 12, 1988

[86] PCT No.: PCT/GB88/00015

§ 371 Date: Jul. 12, 1990

§ 102(e) Date: Jul. 12, 1990

[87] PCT Pub. No.: WO89/06780

PCT Pub. Date: Jul. 27, 1989

[51] Int. Cl.[5] ..... F42D 5/00

[52] U.S. Cl. ..... 102/303; 102/307; 102/323; 102/325

[58] Field of Search ..... 102/303, 307, 323, 325

[56] References Cited

U.S. PATENT DOCUMENTS

| | | | |
|---|---|---|---|
| 3,172,361 | 3/1965 | Thouzeau | 102/25 |
| 3,806,025 | 4/1974 | Marshall | 229/62.5 |
| 4,151,798 | 5/1979 | Ridgeway | 102/24 |
| 4,498,391 | 2/1985 | Gergö | 102/312 |
| 4,736,796 | 4/1988 | Arnall et al. | 166/292 |
| 4,836,079 | 6/1989 | Barrett | 102/303 X |
| 4,905,601 | 3/1990 | Gabriel et al. | 102/307 |

*Primary Examiner*—Peter A. Nelson

*Attorney, Agent, or Firm*—William A. Drucker

[57] ABSTRACT

The invention relates to a new method of using explosives.

In the past it was the practice to use the shock wave front or the pressure pulse, or both, generated by a detonated explosive mass to directly affect a target or to deform and drive a solids element against the target.

In the method proposed by the present invention the explosive mass (11) and a compressible focussing means (12) are supported in a liquid medium. The focussing means (12) lie between the explosive mass and the target (T) and is spaced therefrom by liquid medium. The compressible focussing means (12) may comprise a compressible solids material or a gas volume.

When the explosive mass (11) is detonated the pressure pulse, and the liquid displaced by the gas bubble generated by the detonation, serve to collapse the focussing means (12), generating high pressure liquid flows directed towards the target (T).

14 Claims, 1 Drawing Sheet

EXPLOSIVES

This invention relates to a method of using explosive charges and to apparatus for practising the said method.

It is well known in the art that when an explosive charge is detonated the detonation produces two major effects on its immediate surroundings;

(1) shock waves, which travel outwardly in all directions from the detonated charge, and (2) a high pressure, generated by the gases produced by the detonating charge, and in all prior methods of using explosives one or the other or both of the above effects are utilized directly to affect a target.

When an explosive charge is used to break rock, masonry or the like masses the explosive is generally confined to a borehole where, on detonation, the shock wave travels outwardly through the surrounding mass having little effect thereon whilst the high pressure developed by the detonated charge produces such compression forces in the surrounding mass as to effect fracture along natural planes of weakness.

For convenience hereinafter the effects of the high pressure on its surroundings shall be referred to as a "pressure pulse".

When a so called "plaster" charge is applied to one surface of a metal sheet or plate part of the shock wave travels through the metal target to blow a so called "spall" from that surface of the metal target remote from the detonated charge. The spall is formed exclusively by the shock wave. The pressure pulse also effects the target and can deform the metal surface which was in contact with the detonated charge such that, if the plaster charge is sufficiently large, the target material between the explosive charge and the spall cavity can be deformed, being bent inwardly to the spall cavity, and in some cases so deformed as to break the metal target. Thus, with this method the shock wave displaces a spall from that surface of the metal target remote from the detonated charge and the pressure pulse can produce deformation of the metal target, including a breakthrough into the spall cavity.

In a more recent use of explosives for cutting targets, such as metal sheets or plates, the explosive mass is arranged to direct two shock wave fronts simultaneously into the target to effect a break of the target along the line of collision of the two shock wave fronts. Thus, in this mode of operation, the target is affected essentially by the shock wave front and the pressure pulse has little effect upon the target.

In the well known "shaped" charge arrangement a solids element is spaced from a target surface and an explosive mass is detonated on that surface or surfaces of the solids element remote from the target. With this arrangement the shock wave front passing through the solids element has little effect thereon but the pressure pulse deforms the solids element and drives that element, in blade-like form, at very high velocity against the target to effect at least an indentation of the target. Thus, with this mode of operation, the useful energy of the explosive mass is directed to the deformation and acceleration of the solids element and has little effect on the target but it is essential for all prior art methods for using shaped charges that the explosive mass be applied directly to the solids element to ensure that the high pressure pulse has the desired effect on the solids element and the solids element must be spaced from the target only by a vacuum, or less preferably a gaseous medium, as any other medium will adversely affect the shape and velocity of the deformed solids element.

There are well known difficulties in utilizing all the aforesaid methods of using explosives in underwater situations. Boreholes are difficult to drill accurately and the difficulties in drilling and charging boreholes increases as the depth of the water increases. Plaster charges have little effect on underwater rock and masonry structures. Two shock wave cutting requires only small amounts of explosive but is relatively ineffective on rock and masonry structures. Shaped charges, requiring as they do a complete absence of liquid medium between the solids element and the target, are complex and expensive to produce, difficult to locate particularly in waters of substantial depth, and as the shaped charge is adversely affected by passage through any fluid medium such charges are useless when the target rock or masonry has a deposit of mud or clay or other sediment thereon and the shaped charge construction cannot be located directly in contact with the solid target to be affected.

The present invention seeks to provide a new method and apparatus for using explosive charges and which method and apparatus has particular advantages in underwater applications.

According to the present invention there is provided a method of using explosives characterised by the steps of locating an explosive mass in a liquid medium in spaced relationship to a target, locating a compressible focussing means between the said explosive mass and the said target, the focussing means being spaced from said explosive mass by liquid medium, and detonating said explosive mass to drive liquid medium through said focussing means to the said target.

It will now be seen that the method of using explosives proposed by the present invention is quite different and distinct from all the prior art methods described hereinbefore in that the proposed method does not rely on the shock wave or the pressure wave generated by the detonated explosive mass to affect the target.

In practice of the method proposed by the present invention the detonation of the explosive mass generates a pressure front which expands outwardly through the liquid medium until part of said pressure front contacts the compressible focussing means, the pressure wave causes the focussing means to collapse in the direction of the target and the rapid collapse of the focussing means generates a very high velocity flow in the liquid directed towards the target.

It will be noted that the method proposed by the invention does not essentially require the target to be surrounded by the liquid medium as it has been found in practice that high speed velocity flows can be generated to affect a target outside the liquid medium.

In one embodiment in accordance with the invention the said focussing means comprise a body of compressible solids material.

In another embodiment in accordance with the invention the said focussing means comprise a gaseous volume. Preferably the said gaseous volume is contained in a preformed collapsible envelope.

In another embodiment in accordance with the invention the said gaseous volume is defined by releasing gas bubbles from a gas source.

In a further embodiment in accordance with the invention the said gaseous volume is generated by detonating an explosive material.

In one embodiment in accordance with the invention the method is characterised by the steps of arranging a plurality of focussing means between the explosive mass and the target, said focussing means being in spaced relationship with liquid medium therebetween, and arranged to successively focus energy generated by the detonated explosive mass towards the target.

In another embodiment in accordance with the invention the method is characterised by the steps of arranging a plurality of focussing means between the explosive mass and the target such that each focussing means serves to focus energy generated by the detonated explosive mass to the target along a direction individual to that focussing means.

The present invention also envisages apparatus for carrying out the method comprising an explosive mass, one or a plurality of compressible focussing means, and means for supporting said explosive mass and said focussing means in fixed, spaced apart relationship.

In another embodiment the apparatus includes an explosive mass and means for producing one or a plurality of gas volumes between said explosive mass and a target.

The invention will now be described further by way of example with reference to the accompanying drawings in which;

FIG. 1 shows, diagrammatically, one embodiment in accordance with the invention.

FIGS. 1*a*, 1*b*, 1*c* and 1*d* show, diagrammatically, the effects of the embodiment shown in FIG. 1 at different stages following detonation.

FIG. 4 shows, diagramatically, a further embodiment in accordance with the invention utilizing a plurality of focussing means and.

In the illustrated examples identical elements are identified by the same numerals.

Figure 1:
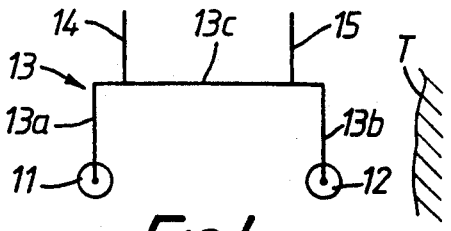

In the embodiment illustrated in FIG. 1 an explosive mass 11 and an explosive charge 12 are supported in spaced apart relationship by two limbs 13*a* and 13*b* respectively of an inverted U shaped frame element 13. Two cables 14 and 15, secured to the bridge 13*b* of element 13 at spaced apart locations, support the apparatus from a flotation member (not shown) on the surface of the water. Thus, the depth of the element 13 can be adjusted by adjusting the lengths of the cables 14 and 15. With the cables 14 and 15 secured to spaced apart locations on the flotation member the apparatus as illustrated can be rotated about a vertical axis by simply rotating the flotation member. Thus, by this means, the element 13 can be located in any desired position relative to a target T, the explosive charge 12 is detonated and the high pressure, high temperature gases generated by the detonation produce a bubble 12*a*.

As is well known in the art the detonation of an explosive charge produces very high temperature and high pressure gases, the pressure in a bubble generated by a detonated explosive can initially exceed thousands of tons per square inch and the high pressure in the gas bubble is transmitted to the surrounding liquid medium to causes the surrounding media, to be displaced violently in all directions away from the centre of the gas bubble to allow the bubble to expand.

With the violent displacement of the surrounding media away from the detonated charge the gas bubble expands, the pressure in the bubble falls, and at that point where the momentum in the surrounding media is arrested the pressure in the bubble can be less than the surrounding pressure of the liquid. At this point of maximum volume of the bubble the system implodes and the surrounding media flows inwardly to collapse the bubble. Being a compressible mass the bubble will reduce in volume to a point at which its internal pressure exceeds the pressure of the surrounding media, when again the bubble will expand. Such a bubble, produced by detonation of an explosive charge, will experience a series of expansion/contraction cycles before it reaches a state of equilibrium. Such behaviour of a bubble, generated by detonation of an explosive charge, is well known in the art.

In accordance with the present invention the explosive mass 11 is detonated after the explosive charge 12 and, in like manner to the detonation of charge 12, the detonation of explosive mass 11 generates a high pressure, high temperature gas bubble which expands displacing the surrounding water violently away from the centre of the gas mass.

Figure 1B:
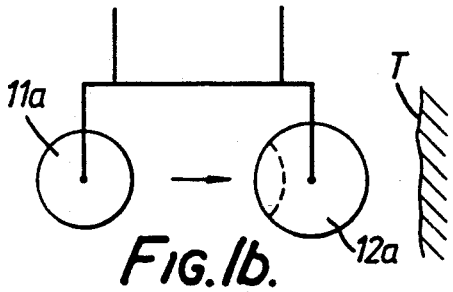

The delay period between the detonation of the explosive charge 12 and the explosive mass is 11 preferably so selected that the gas bubble 12*a* is substantially at its maximum volume, lowest pressure condition at that point when the pressure pulse generated by the expansion of the bubble 11*a*, reaches the bubble 12*a*. At this point the displacement of water by the bubble 12*a* towards the bubble 11*a* is minimal but the bubble 11*a* is generating pressure pulse in the water and the water between 11*a* and 12*a*, is at high pressure and is being driven towards bubble 12*a*, whereupon that part of bubble 12*a* towards bubble 11*a* is collapsed, generally as shown in FIG. 1*b*. With the collapse of that side of the bubble 12*a* towards bubble 11*a* the high pressure water is focused by the interface between the gas bubble 12*a* and the surrounding media and produces a high velocity flow which passes through the bubble 12*a* thus forming the bubble 12*a* into an annulus, and the high velocity flow strikes the target T. Whilst the pressure pulse is being continued by the bubble 11*a* the high pressure jet through bubble 12*a* will be maintained but the high velocity flow of the water in the direction from the bubble 11*a* to bubble 12*a* will entrain surrounding water and, with the release of pressure in the surrounding media between bubble 11*a* and bubble 12*a*, the bubble 11*a* will be drawn towards the bubble 12*a* whereupon, as it approaches bubble 12*a* the effect of the expansions of bubble 11*a*, due to its cyclic pulses, will assist the maintenance of high pressure flows through the bubble 12*a* to the target T.

Figure 1C:
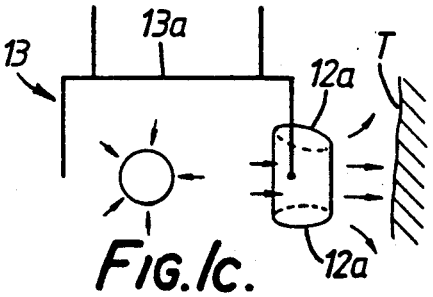

The formation of the bubble 12*a* into annular form, with displacement of the bubble 11*a* towards the annulus 12*a* is shown in FIG. 1*c* and the continuing expansion of the bubble 11*a*, with degradation of the annulus 12*a* is shown in FIG. 11*d*.

It will be seen from the above that the system according to the present invention, produces high velocity liquid flows against the target and which high velocity flows can have a greater effect upon a rock or masonry target than any prior art underwater explosive arrangement known to date.

Further, with the formation of the gas bubble 12*a* generating pressure pulses through the water, with pressure flow of the water, deposits on the target T can be displaced thereby but, in the event, the high velocity liquid flows will cut through any sedimentary deposit to affect the target T.

Figure 2:
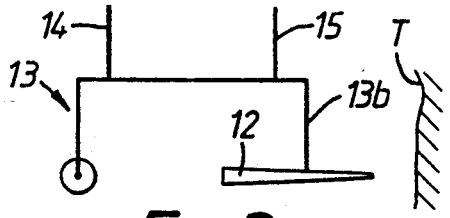
FIG. 2 shows, diagramatically, a second embodiment of the invention utilizing a shaped explosive charge.
Figure 1A:
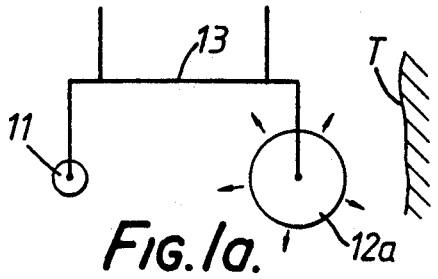

In the arrangement shown in FIG. 2 the explosive charge 12, supported by the limb 13*b* of element 13, is of elongate form with its longitudinal axis extending between the explosive mass 11 and the target T. As illustrated, the explosive charge 12 reduces in cross section from its largest cross section nearest the explosive mass 11, towards the target. Such an arrangement, on detonation of the explosive charge 12, produces an elongate gas bubble which is most effective in focussing the liquid flows towards the target.

Figure 3:
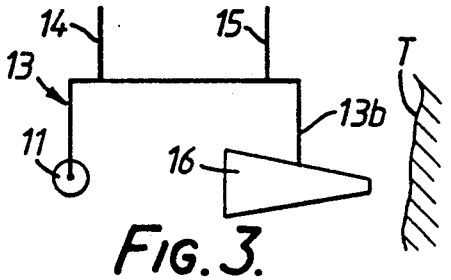
FIG. 3 shows, diagramatically, a third embodiment of the invention utilizing a compressible solids focussing means.

In the arrangement illustrated in FIG. 3 the limb 13*b* of element 13 supports a truncated conical body 16 the axis of which extends in that direction between the explosive mass 11 and the target T.

The body 16 may comprise a gas-filled envelope or a body of solids material, such as an expanded polystyrene, and the essential feature of the body 16 is that it must be compressible when struck by the pressure pulse generated by detonation of the explosive mass 11. Thus, on detonation of the explosive mass 11, the pressure pulse in the surrounding water generated by the expansion of the gas bubble 11*a* causes that end of body 16 nearest the bubble 11*a* to collapse inwardly of the body 16, the water flows into and through the collapsible body 16 being focused by the disrupted or deformed body 16 to generate high velocity water flows towards the target T.

Figure 4:
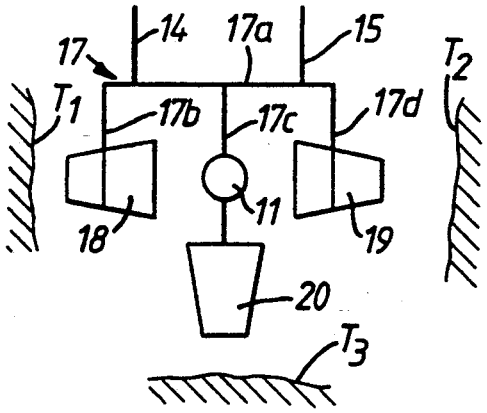

In the embodiment illustrated in FIG. 4 a frame, generally indicated by numeral 17, comprises a horizontal or bridge element 17*a*, supported by cables 14 and 15 in identical manner to the prior embodiments, with three limbs 17*b*, 17*c* and 17*d* depending downwardly therefrom. The outer limbs 17*b* and 17*d* support bodies 18 and 19 and the central 17*c* supports an explosive mass 11 and a focussing body 20.

The focussing bodies 18, 19 and 20 are identical in their shape and configurations and may be substantially identical to the body 16 illustrated in FIG. 3 and may, therefore, conveniently comprise gas filled envelopes or compressible bodies of solids material or any combination of both. Each of the bodies 18, 19 and 20 is of generally truncated conical form, the central axis of the body 18 lies substantially horizontal with the greatest cross section of the cross section form nearest the explosive mass 11, the body 19 has its axis substantially horizontal with the major cross section of its form adjacent the explosive mass 11, and the body 20 has its axis vertical with its major cross section nearest the explosive mass 11. The bodies 18, 19 and 20 are equally distant from the explosive mass 11.

In the example illustrated in FIG. 4 the arrangement is located in a trough or channel filled with water and that side of the channel adjacent body 18 comprises target T1, that side of the channel adjacent body 19 comprises target T2, and the base of the channel, adjacent body 20, comprises target T3.

With the arrangement correctly located in the channel the explosive mass 11 is detonated and the pressure pulse in the water generated by the expansion of the gas bubble 11*a* is transmitted simultaneously to the three bodies 18 19 and 20, that end region of each body 18 19 and 20 nearest the gas bubble 11*a* will collapse under the pressure wave and high velocity water flows will be generated and focussed through the compressible bodies 18, 19 and 20. The compressible body 18 will focus the high velocity water flows therethrough against the target T1, the body 19 will focus the high velocity flows therethrough against the target T2 and the body 20 will focus high velocity flows against the the base of the channel, target T3. Thus, high velocity water flows can be focused in different directions from a single explosive mass 11.

Figure 5:
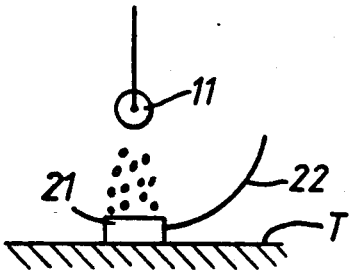
FIG. 5 shows, diagramatically, a further embodiment of the invention utilizing a plurality of focussing means between the explosive mass and the target.
Figure 1D:
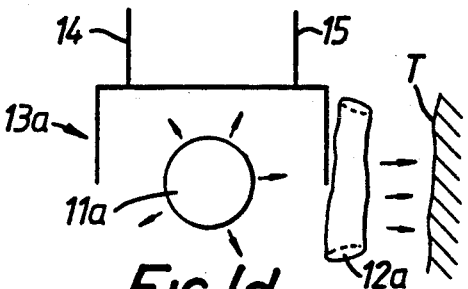

In the example illustrated in FIG. 5 a weighted, gas bubble release block 21 rests on the bottom and is connected to a locating vessel on the surface by a cable 22. The cable 22 may conveniently comprise a gas hose through which gas can be pumped from the surface vessel to the gas release block 21. With this arrangement the surface vessel can tow the block 21 over the surface of the bottom below the water as and until the block 21 is located in the desired position. Thereafter, the explosive mass 11 is lowered to a desired position directly above the block 21 and is detonated whilst the block 21 is releasing bubbles.

When the explosive mass is detonated the pressure pulse acts on all the bubbles between the expanding bubble 11*a* and the block 21, each bubble will focus the water driven against its collapsed upper end (that end closest to the gas bubble 11*a*,) and the overall effect is a plurality of focusing devices between the gas bubble 11*a* and the bottom which results in an overall high velocity flow of water against the bottom.

It will be appreciated that the effects of the high velocity follows, generated by collapse of compressible body or bodies, will be dependant upon the distance between the focusing device and the target but in practice high velocity flows can be experienced more than a meter beyond the focusing means.

It will be appreciated that the method proposed by the present invention can be practised to obtain a high pressure liquid flow concentrated on relatively small areas of the target or on a relatively large area of the target, dependant upon the result desired, but the method can be practised in many ways and, by way of example, two explosive charges of elongate form of any desired length, with means for supporting the said charges in spaced apart relationship, can be detonated as proposed by the present invention to direct a knife-like high velocity water flow, of a length substantially equal to the length of the combined explosive charges, against a target.

Further, the target need not essentially be within the liquid medium and the method proposed by the present invention can be practised to generate high speed velocity flows capable of passing upwardly through the free surface of the liquid medium to affect a target outside the liquid medium.

I claim:

1. A method of using explosives characterised by the steps of:

(a) locating an explosive mass in a liquid medium in spaced relationship to a target, (b) locating a compressible focussing means spaced from said explosive mass by liquid medium between said explosive mass and said target, and (c) driving liquid medium through said focussing means to the said target by detonating said explosive mass.

2. A method according to claim 1 characterised in that the said focussing means comprise a body of compressible solids material.

3. A method according to claim 1 characterised in that the said focussing means comprise a gaseous volume.

4. A method according to claim 3 characterised in that the said gaseous volume is contained in a preformed collapsible envelope.

5. A method according to claim 3 characterised in that said gaseous volume is defined by releasing gas bubbles from a gas source.

6. A method according to claim 3 characterised in that said gaseous volume is generated by detonating an explosive material.

7. A method according to claim 1 characterised by the steps of arranging a plurality of focussing means between the explosive mass and the target, said focussing means being in spaced apart relationship with liquid medium therebetween and arranged to successively focus energy generated by the detonated explosive mass towards the target.

8. A method according to claim 1 inclusive characterised by the steps of arranging a plurality of focussing means between the explosive mass and the target such that each focussing means serves to focus energy generated by the detonated explosive mass to the target along a direction individual to that focussing means.

9. Apparatus which comprises an explosive mass, one or a plurality of compressible focussing means, and means for supporting said explosive mass and said focussing means in fixed, spaced apart relationship.

10. Apparatus which includes an explosive mass and means for producing one or a plurality of gas volumes between said explosive mass and a target.

11. A method according to claim 2 characterized by the steps of arranging a plurality of focussing means between the explosive mass and the target, said focussing means being in spaced apart relationship with liquid medium therebetween and arranged to successively focus energy generated by the detonated explosive mass towards the target.

12. A method according to claim 3 characterized by the steps of arranging a plurality of focussing means between the explosive mass and the target, said focussing being in spaced apart relationship with liquid medium therebetween and arranged to successively focus energy generated by the detonated explosive mass towards the target.

13. A method according to claim 2 characterized by the steps of arranging a plurality of focussing means between the explosive mass and the target such that each focussing means serves to focus energy generated by the detonated explosive means to the target along a direction individual to that focussing means.

14. A method according to claim 3 characterized by the steps of arranging a plurality of focussing means between the explosive mass and the target such that each focussing means serves to focus energy generated by the detonated explosive mass to the target along a direction individual to that focussing means.

* * * * *